US005538224A

United States Patent [19]

Powell et al.

[11] Patent Number: 5,538,224

[45] Date of Patent: Jul. 23, 1996

[54] LINE-HANDLING BLOCK COMPRISING TWO CHEEKS HAVING BAYONET MATING INTERCONNECTION

[75] Inventors: Melvyn Powell, Waterlooville; Peter J. Coe, Hayling Island, both of England

[73] Assignee: Lewmar Marine Limited, Hampshire, England

[21] Appl. No.: 132,896

[22] Filed: Oct. 7, 1993

[30] Foreign Application Priority Data

Nov. 30, 1992 [GB] United Kingdom ..... 9225051

[51] Int. Cl.[6] ..... B66D 3/04

[52] U.S. Cl. ..... 254/406; 254/416

[58] Field of Search ..... 254/406, 402, 254/404, 412, 413

[56] References Cited

U.S. PATENT DOCUMENTS

| | | | |
|---|---|---|---|
| 779,437 | 1/1905 | Nettle | 254/412 X |
| 973,092 | 10/1910 | Whitman | 254/412 |
| 980,010 | 12/1910 | Sandmyre | 254/412 |
| 1,168,871 | 1/1916 | Ferdinand | 254/412 |
| 1,406,560 | 2/1922 | Block | 254/194 |
| 1,424,503 | 8/1922 | Block | 254/192 |
| 1,629,690 | 5/1927 | Fentress | 254/404 X |
| 1,769,411 | 7/1930 | Bennett | 254/404 |
| 1,800,700 | 4/1931 | Patton | 254/412 |
| 2,584,783 | 2/1952 | Berg | 254/406 |
| 2,754,084 | 7/1956 | Le Bus, Sr. | 254/406 |
| 3,526,389 | 9/1970 | Horgan et al. | 254/195 |
| 4,614,332 | 9/1986 | Wilson | 254/406 X |
| 5,056,760 | 10/1991 | Jorgensen | 254/406 |

FOREIGN PATENT DOCUMENTS

| | | |
|---|---|---|
| 0510432 | 10/1992 | European Pat. Off. . |
| 3229984 | 2/1984 | Germany . |
| 1196108 | 6/1970 | United Kingdom . |
| 2190436 | 11/1987 | United Kingdom . |

*Primary Examiner*—Daniel P. Stodola
*Assistant Examiner*—Emmanuel M. Marcelo
*Attorney, Agent, or Firm*—Longacre & White

[57] ABSTRACT

A block for line-handling comprises two cheeks and a rotatable sheave sandwiched between the two cheeks. The two cheeks mate together through a central aperture of the sheave by a relative rotation of the cheeks via a bayonet fitting. The mated cheeks are secured to each other by fixing pins, which also secure a swivel attachment member to the block. Bearing elements are used for rotatably supporting the sheave to prevent its translational movement relative to the cheeks.

15 Claims, 2 Drawing Sheets

LINE-HANDLING BLOCK COMPRISING TWO CHEEKS HAVING BAYONET MATING INTERCONNECTION

FIELD OF THE INVENTION

This invention relates to a block for line-handling, more particularly, to a block for handling, guiding, turning or deflecting a line or a cable, such as a pulley block, a foot block or a turning block.

BACKGROUND OF THE INVENTION

In the past, line-handling blocks have included a rotatable sheave sandwiched between two cheeks, which were held together by means of nuts and bolts, rivets or the like. Therefore, it is a relatively time-consuming job to assemble such blocks.

SUMMARY OF THE INVENTION

It is an object of this invention to provide a line-handling block which is easier to assemble than previous blocks.

A feature of the present invention is a mating of flanges of the cheeks through the middle of the sheave and in such a way as to interengage the cheeks against being forced apart. Preferably this mating involves relative rotation of the cheeks, most suitably by a bayonet coupling, but e.g. screw-threading is possible. This mating construction allows the use of fewer parts than previous ones, and is quick and simple to assemble. Having been mated, the two cheeks only require one or more further securing means to prevent any relative movement which might release their engagement. Because these need resist only relative rotation of the cheeks they may be smaller and less numerous than the fasteners used in previous blocks.

To provide a thrust bearing for the sheave there may be an annular groove cut into each end wall of the sheave which has a mouth of restricted width. Ball bearing elements of a plastics material such as acetal are deformed somewhat and introduced into the groove through the restricted mouth. Once inside the groove, the elements return to a spherical shape, the diameter of which is larger than the width of the groove mouth and hence the elements are retained within the groove. The advantage of this arrangement is that the axial thrust bearings may be assembled with the sheave before the final assembly with the cheeks.

Windows may be provided in the flanges of the malted body of the cheeks which give access to bearing elements, and allow flushing of those elements without the need to disassemble the pulley block. The windows also reduce the weight of the block.

The block will also usually have a rotatable swivel pin which allows attachment of the block to some external body. This swivel pin is preferably retained in the block by constraint between a groove in the swivel pin and the securing means. The dual utility of the securing means again minimizes the number of parts in the complete block and makes assembly of the block quicker and easier.

It should be understood that the term line-handling block in this application includes all devices having similar functions, such as a pulley block, a foot block or a turning block, which can be fixed to the deck of a boat and used to deflect a line to a winch or some other part of the boat.

DETAILED DESCRIPTION OF A PREFERRED EMBODIMENT

Figure 1:
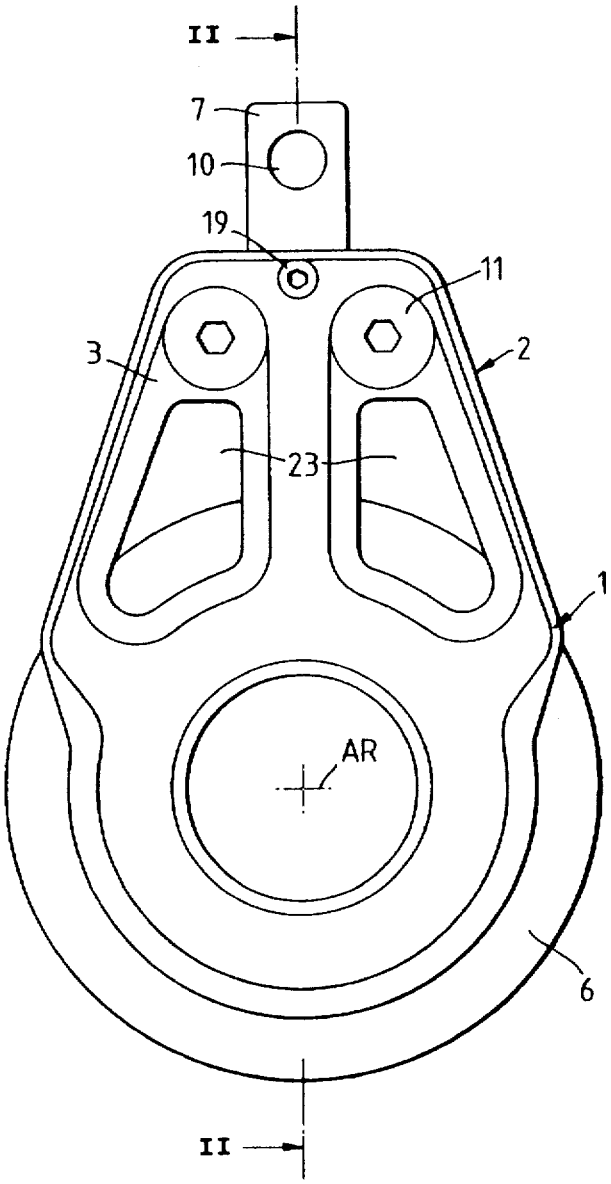
FIG. 1 is a face view of the pulley block.

FIG. 1 shows a line-handling block 1 including two metal cheeks 3 and a rotatable sheave 6. Bosses 4 are integral parts of the cheeks 3 and are mated by relative rotation of the cheeks, e.g. via a bayonet coupling 5 through an aperture in the center of the sheave 6 in which its axis of rotation is positioned.

Figure 3:
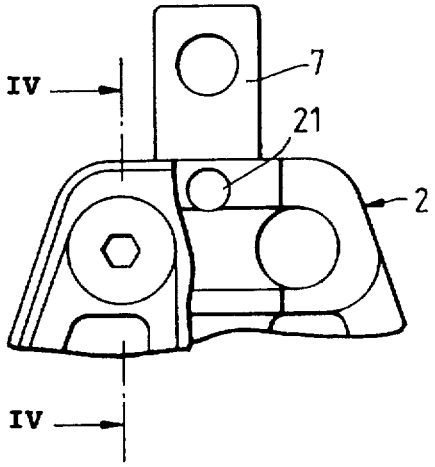
FIG. 3 is a detail of FIG. 1.
Figure 4:
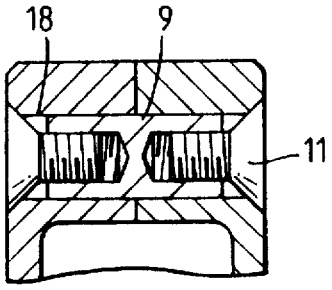
FIG. 4 is a section IV—IV of FIG. 3.
Figure 5:
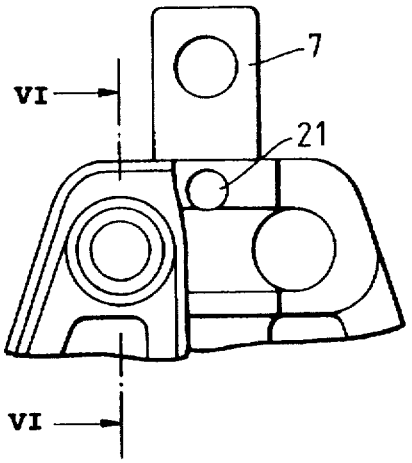
FIG. 5 is a detail of a variant of FIG. 1.
Figure 6:
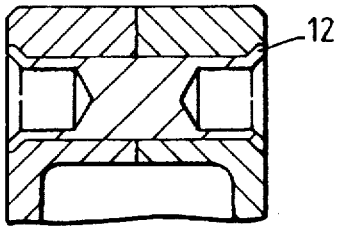
FIG. 6 is a section VI—VI of FIG. 5.
Figure 7:
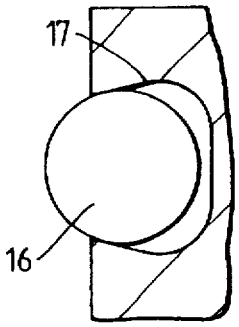
FIG. 7 is a detail of FIG. 2.

Part of the cheeks 3 extend beyond the outer radius of the sheave 6 to form a head 2. In the head 2 there are securing means in the form of two fixing pins 9 each running through both cheeks 3 outside the diameter of the sheave 6; these fixing pins prevent relative rotation of the cheeks 3. Each fixing pin 9 is fixed in the block head 2 by either a screw 11 in either end (FIGS. 3 and 4) or by having the pin ends formed into rivets 12 (FIGS. 5 and 6).

There is a swivel pin 7 in a hole 20 in the block head 2 formed equally by a semi-cylindrical recess in each of the two cheeks. Its axis is perpendicular to the axis of rotation of the sheave. The swivel pin 7 has a circumferential groove 8 of semi-circular cross-section in which the securing means, here two fixing pins 9 are seated. The fixing pins 9 are positioned at diametrically opposite sides of the groove 8 so that the swivel pin 7 is constrained to only move rotationally about its own axis. Part of the swivel pin 7 projects beyond the head stock 2 and has there a hole 10 to allow attachment of the block to an external body.

Figure 2:
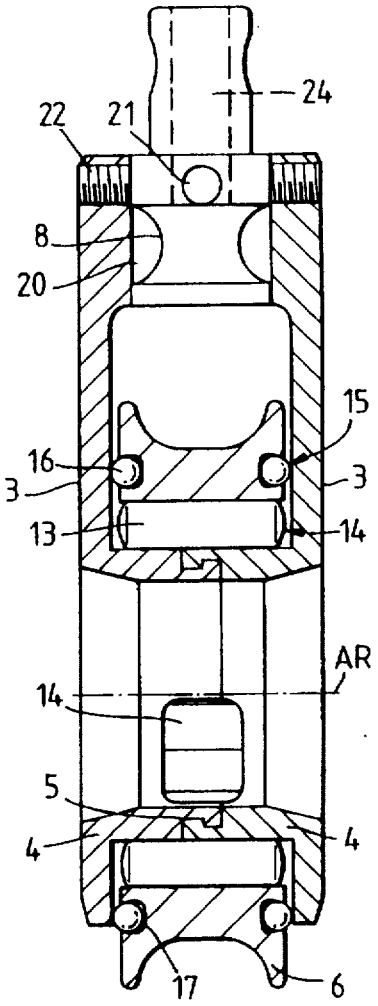
FIG. 2 is a sectional elevation on the plane II—II of FIG. 1.

There are two coaxial grub screws 19, one in a hole 22 in each cheek 3, which have an axis perpendicular to and coincident with the axis of the swivel pin 7. There are four blind bores 21 in the swivel pin 7 any of which may be aligned with grub screws 19 such that when the grub screws 19 are screwed into the bore 21, the swivel pin 7 is prevented from rotating about its axis. The pin 7 is hollowed by a hole to lighten it, as indicated by dotted lines 24, FIG. 2, the hole having a diameter established by considering the loads the pin has to accommodate.

The sheave 6 is borne radially in relation to the cheeks 3 by a roller bearing 14, made up of a plurality of roller bearing elements 13, each of which is in contact with the inner circular wall of the sheave 6 and the outer wall of the cheek bosses 4. Access to the roller bearing elements 13 is provided by windows 14' in the mated assembly of the cheek flanges 4.

The sheave 6 is fixed axially by thrust bearings. These bearings are made up of slightly compressible plastics material ball elements 16 e.g. of an acetal resin, captured in circular grooves 17 in the end walls of the sheave 6. The thrust elements 16 have an undeformed diameter greater than the width of the mouth of the groove 17 which allows the thrust bearings 15 to be assembled with the sheave 6 before final assembly with the cheeks 3.

There are two cutaways 23 in the block head 2 of each cheek 3. These serve to reduce the weight of the block 1.

The block is assembled by fitting the axial thrust bearing elements 16 into the grooves 17 in the sheave 6. This assembly and the roller bearings 14 are fitted onto the boss 4 of one of the cheeks 3. The other cheek 3 is then offered up to the first and rotated so as to mate the cheeks 3 by the bayonet fixing 5. The swivel pin 7 is then introduced into the hole 20 in the block head 2. The two fixing pins 9 are then slid into the holes 18 in the head stock 2, to fix the cheeks 3 and the swivel pin 7, and are fixed by screws 11 or formation of the pin ends into rivets 12.

Finally the grub screws 19 are screwed into the holes 22 in the cheeks 3, if desired.

We claim:

1. A block for line-handling comprising:

first and second cheeks having means for mating with each other;

a sheave with a central aperture therein;

said cheeks comprising bearing means for rotatably bearing said sheave for rotation about an axis in the central aperture thereof; and said mating means comprising interengagement means for holding said cheeks together in the direction of said axis;

said first and second cheeks being arranged to sandwich said sheave rotatably therebetween and to mate with each other by interengagement of said mating means circumjacent said central aperture of said rotatable sheave, wherein said mating means is a bayonet fitting and said first and second cheeks interengage with each other via said mating means by a relative rotation therebetween.

2. A block according to claim 1, wherein each of said first and second cheeks comprises an outer portion extending beyond an outer radius of said sheave, and further comprises at least one securing means for fixing said first and second cheeks to each other via said outer portion so as to prevent relative rotational movement of said first and second cheeks.

3. A block according to claim 2, wherein said swivel attachment means comprises a shaft away from the block, said shaft comprising an axially directed relief bore.

4. A block according to claim 2, further comprising swivel attachment means, wherein said swivel attachment means is rotatably secured to said pulley block.

5. A block according to claim 4, wherein said swivel attachment means is rotatably secured to said pulley block by a constraint between itself and at least one of said securing means.

6. A block according to claim 1, further comprising bearing means between said sheave and said cheeks for preventing transational movement of said sheave with respect to said cheeks.

7. A block according to claim 6, wherein said sheave has at least one axial side face with a groove formed thereon and said bearing means comprise at least axial thrust bearing elements captive within said groove.

8. A block according to claim 7, wherein said groove is formed with a restricted mouth, and said axial thrust bearing elements are balls each having a natural diameter larger than said restricted mouth.

9. A block according to claim 8, wherein said mating means of said first and second cheeks comprise mating flanges with at least one window formed therein to provide access to said bearing means.

10. A block for line handling comprising:

first and second cheeks;

a shaft on each of said first and second cheeks;

said shafts protruding towards each other and comprising interlocking bayonet mating means;

a sheave with an outer radius and a central aperture with an axial length;

said shafts each penetrating into the axial length of the central aperture, whereby said interlocking bayonet mating means interlock said shafts on said first and second cheeks circumjacent said central aperture;

said sheave being supported on said shafts for rotation about an axis of rotation;

said first and second cheeks comprising a portion radially beyond the outer radius of the sheave and comprising means for preventing relative rotation of the cheeks.

11. A block according to claim 10, further comprising swivel attachment means, wherein said swivel attachment means is rotatably secured to said pulley block.

12. A block according to claim 11, wherein said swivel attachment means is rotatably secured to said pulley block by a constraint between itself and at least one of said securing means.

13. A block according to claim 10, further comprising bearing means between said sheave and said cheeks for preventing translational movement of said sheave with respect to said cheeks.

14. A block according to claim 13, wherein said sheave has at least one axial side face with a groove formed thereon and said bearing means comprise at least axial thrust bearing elements captive within said groove.

15. A block according to claim 14, wherein said groove is formed with a restricted mouth, and said axial thrust bearing elements are balls each having a natural diameter larger than said restricted mouth.

* * * * *